US009433292B2

(12) United States Patent
Dubina et al.

(10) Patent No.: US 9,433,292 B2
(45) Date of Patent: Sep. 6, 2016

(54) ALIGNMENT GUIDE

(71) Applicant: Electrolux Home Products, Inc., Charlotte, NC (US)

(72) Inventors: Paul Dubina, Anderson, SC (US); Krystin Kittredge, Anderson, SC (US); Andrew D. Brown, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 11 days.

(21) Appl. No.: 14/576,077

(22) Filed: Dec. 18, 2014

(65) Prior Publication Data

US 2016/0174713 A1 Jun. 23, 2016

(51) Int. Cl.

| | |
|---|---|
| ***A47B 96/14*** | (2006.01) |
| ***A47B 96/16*** | (2006.01) |
| ***A47B 88/04*** | (2006.01) |
| ***A47B 88/08*** | (2006.01) |

(52) U.S. Cl.

CPC ..... *A47B 96/16* (2013.01); *A47B 88/04* (2013.01); *A47B 88/044* (2013.01); *A47B 88/08* (2013.01)

(58) Field of Classification Search

CPC .... A47B 88/04; A47B 88/044; A47B 88/08; A47B 96/16; A47B 96/14

USPC ..... 312/402, 404, 405, 326, 329, 348.4, 312/334.1, 334.8, 352

See application file for complete search history.

(56) References Cited

U.S. PATENT DOCUMENTS

| | | | | |
|---|---|---|---|---|
| 4,143,443 | A * | 3/1979 | Reyle | E05D 11/0009 16/262 |
| 7,065,832 | B2 | 6/2006 | Pohl | |
| 7,975,395 | B2 | 7/2011 | Keller et al. | |
| 8,215,730 | B2 | 7/2012 | Brown et al. | |
| 2010/0095597 | A1 | 4/2010 | Zounis, Jr. | |
| 2010/0283359 | A1 * | 11/2010 | Hottmann | A47B 88/0051 312/204 |
| 2012/0032572 | A1 | 2/2012 | Lee | |
| 2012/0211636 | A1 | 8/2012 | Sirek et al. | |

* cited by examiner

*Primary Examiner* — James O Hansen
(74) *Attorney, Agent, or Firm* — Pearne & Gordon LLP

(57) ABSTRACT

An alignment guide and method of assembling an apparatus with an alignment guide is provided. The alignment guide comprises a body having a first abutment surface and a second abutment surface. The apparatus comprises a cabinet defining an enclosure, a door, and a coupling mechanism for movably coupling the door to the cabinet to permit translational movement of the door relative the cabinet. The method comprises aligning the door relative to the cabinet with the alignment guide by abutting the first abutment surface of the alignment guide against a surface of the cabinet while abutting the second abutment surface of the alignment guide against a surface of the door. The method further comprises fixedly coupling the door to a support member of the coupling mechanism while the door is aligned to the cabinet with the alignment guide.

18 Claims, 8 Drawing Sheets

ALIGNMENT GUIDE

TECHNICAL FIELD

The present disclosure relates to an alignment guide and more particularly, to a method of assembling an apparatus with the alignment guide.

BACKGROUND

A cabinet can include one or more compartments. For example, a refrigerator cabinet can include a freezer storage compartment and a fresh food storage compartment that are arranged over-and-under and separated by a horizontal center mullion wall in a bottom-mount freezer configuration. The compartment(s) of the cabinet can include a drawer assembly having a door and a receptacle that can be moved between an open and closed position. The door can be aligned relative to the cabinet to provide a seal between the door and the cabinet when the drawer assembly is in the closed position.

SUMMARY

The following presents a simplified summary of the disclosure in order to provide a basic understanding of some example aspects described in the detailed description.

In accordance with a first aspect, a method of assembling an apparatus with an alignment guide is provided. The alignment guide comprises a body having a first abutment surface and a second abutment surface. The apparatus comprises a cabinet defining an enclosure, a door, and a coupling mechanism for movably coupling the door to the cabinet to permit translational movement of the door relative the cabinet. The method comprises aligning the door relative to the cabinet with the alignment guide by abutting the first abutment surface of the alignment guide against a surface of the cabinet while abutting the second abutment surface of the alignment guide against a surface of the door. The method further comprises fixedly coupling the door to a support member of the coupling mechanism while the door is aligned to the cabinet with the alignment guide.

In one example of the first aspect, the door is aligned relative to the cabinet with the alignment guide by abutting the first abutment surface of the alignment guide against a front surface of the cabinet while abutting the second abutment surface of the alignment guide against a rear surface of the door.

In another example of the first aspect, the first abutment surface and the second abutment surface are substantially parallel to each other.

In yet another example of the first aspect, the door is fixedly coupled to the support member with at least one fastener. In one example the alignment guide comprises an aperture extending through the body. While the door is aligned relative to the cabinet with the alignment guide, the alignment guide is positioned such that the fastener can be fastened with a fastening tool extending through the aperture. In another example, the aperture is elongated and extends longitudinally in a direction substantially parallel to the first abutment surface and the second abutment surface.

In still yet another example of the first aspect, the coupling mechanism comprises a closing mechanism configured to pull the door toward the cabinet when the door is coupled to the support member and a distance between the surface of the cabinet and the surface of the door is less than a predetermined distance. In one example, when the first abutment surface of the alignment guide abuts the front surface of the cabinet and the second abutment surface of the alignment guide abuts the rear surface of the door, the distance between the surface of the cabinet and the surface of the door is less than the predetermined distance. In another example, when the first abutment surface of the alignment guide abuts the surface of the cabinet and the second abutment surface of the alignment guide abuts the surface of the door, the closing mechanism pulls the surface of the door against the second abutment surface.

In another example of the first aspect, the method further comprises adjustably coupling the door to the support member before aligning the door relative to the cabinet. In yet another example of the first aspect, the method further comprises separating the first abutment surface from the surface of the cabinet and separating the second abutment surface from the surface of the door after the door is fixedly coupled to the support member. In still yet another example of the first aspect, the body of the alignment guide comprises a third abutment surface that extends transverse to the first and second abutment surfaces. In one example, the door is aligned relative to the cabinet with the alignment guide by abutting the third abutment surface of the alignment guide against a second surface of the door or cabinet. In another example, the third abutment surface intersects with one of the first and second abutment surfaces to form a shoulder configured to mate with a corner portion of the door or cabinet.

The first aspect can be provided alone or in combination with one or any combination of the examples of the first aspect discussed above.

In accordance with a second aspect, an alignment guide for assembling an apparatus is provided. The apparatus comprises a cabinet defining an enclosure, a door, and a coupling mechanism for movably coupling the door to the cabinet to permit translational movement of the door relative the cabinet. The alignment guide comprises a body having a first abutment surface for abutting against a surface of the cabinet and a second abutment surface for abutting against a surface of the door while the first abutment surface abuts the surface of the cabinet. The alignment guide further comprises an aperture extending through the body. The door can be aligned relative to the cabinet with the alignment guide by abutting the second abutment surface against the surface of the door while the first abutment surface abuts the surface of the cabinet. The door can be fixedly coupled to the support member with at least one fastener. The aperture is configured such that a fastening tool can extend through the aperture to fasten the fastener while the door is aligned relative to the cabinet with the alignment guide.

In one example of the second aspect, a third abutment surface extending transverse to the first and second abutment surfaces for abutting against a second surface of the door or cabinet. In one example, the third abutment surface intersects with one of the first and second abutment surfaces to form a shoulder configured to mate with a corner portion of the door or cabinet.

In another example of the second aspect, the coupling mechanism comprises a closing mechanism configured to pull the door toward the cabinet when the door is coupled to the support member and a distance between the surface of the cabinet and the surface of the door is less than a predetermined distance. The alignment guide is configured such that when the first abutment surface of the alignment guide abuts the front surface of the cabinet and the second abutment surface of the alignment guide abuts the rear surface of the door, the distance between the surface of the cabinet and the surface of the door is less than the predetermined distance.

In yet another example of the second aspect, the first abutment surface and the second abutment surface are substantially parallel to each other. In one example, the aperture is elongated and extends longitudinally in a direction substantially parallel to the first abutment surface and the second abutment surface.

The second aspect can be provided alone or in combination with one or any combination of the examples of the second aspect discussed above.

DETAILED DESCRIPTION OF THE DRAWINGS

Embodiments of the invention are better understood when the following detailed description is read with reference to the accompanying drawings, in which.

DETAILED DESCRIPTION

Figure 1:
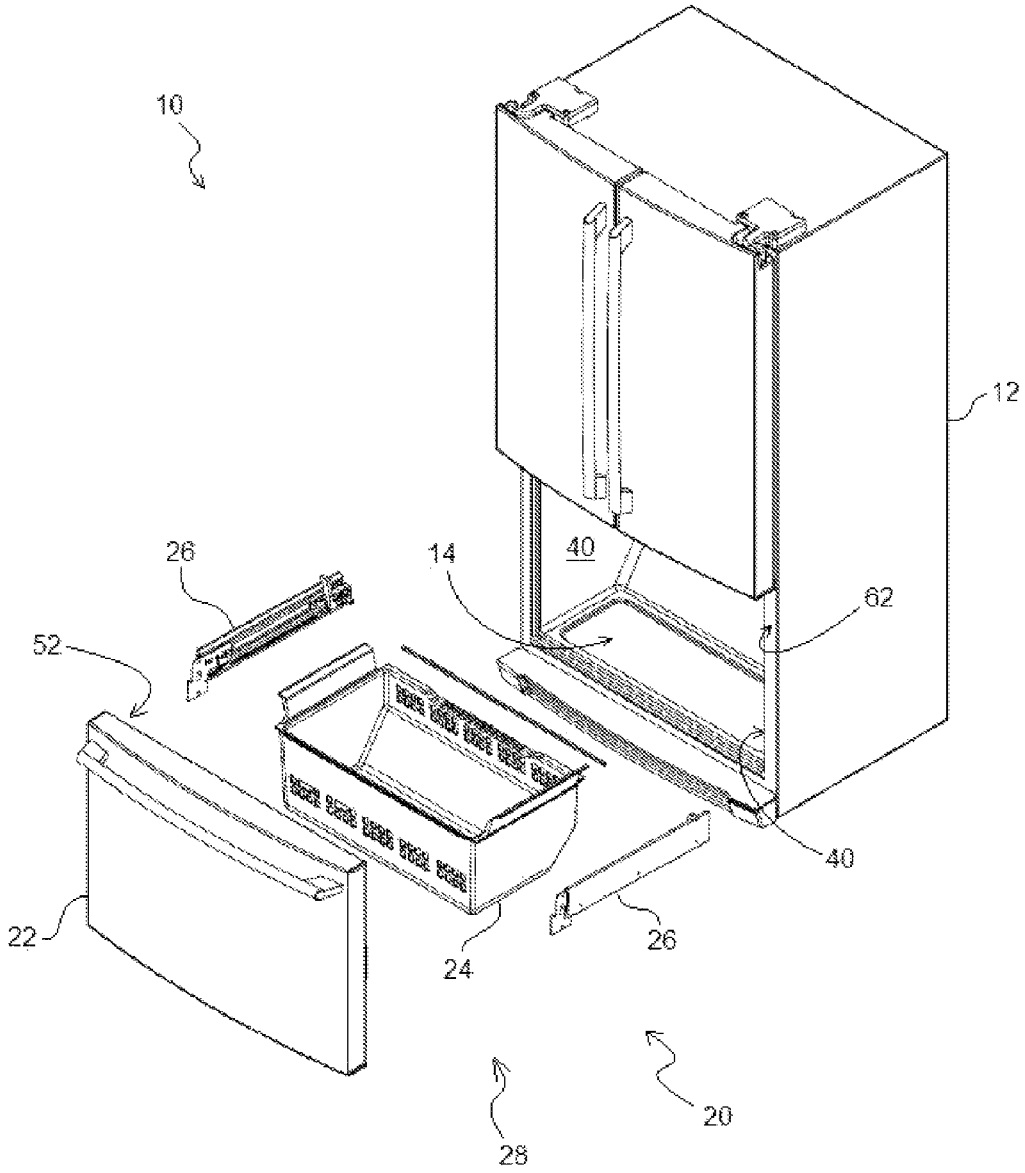
FIG. 1 is an exploded view of an example apparatus.
Figure 2:
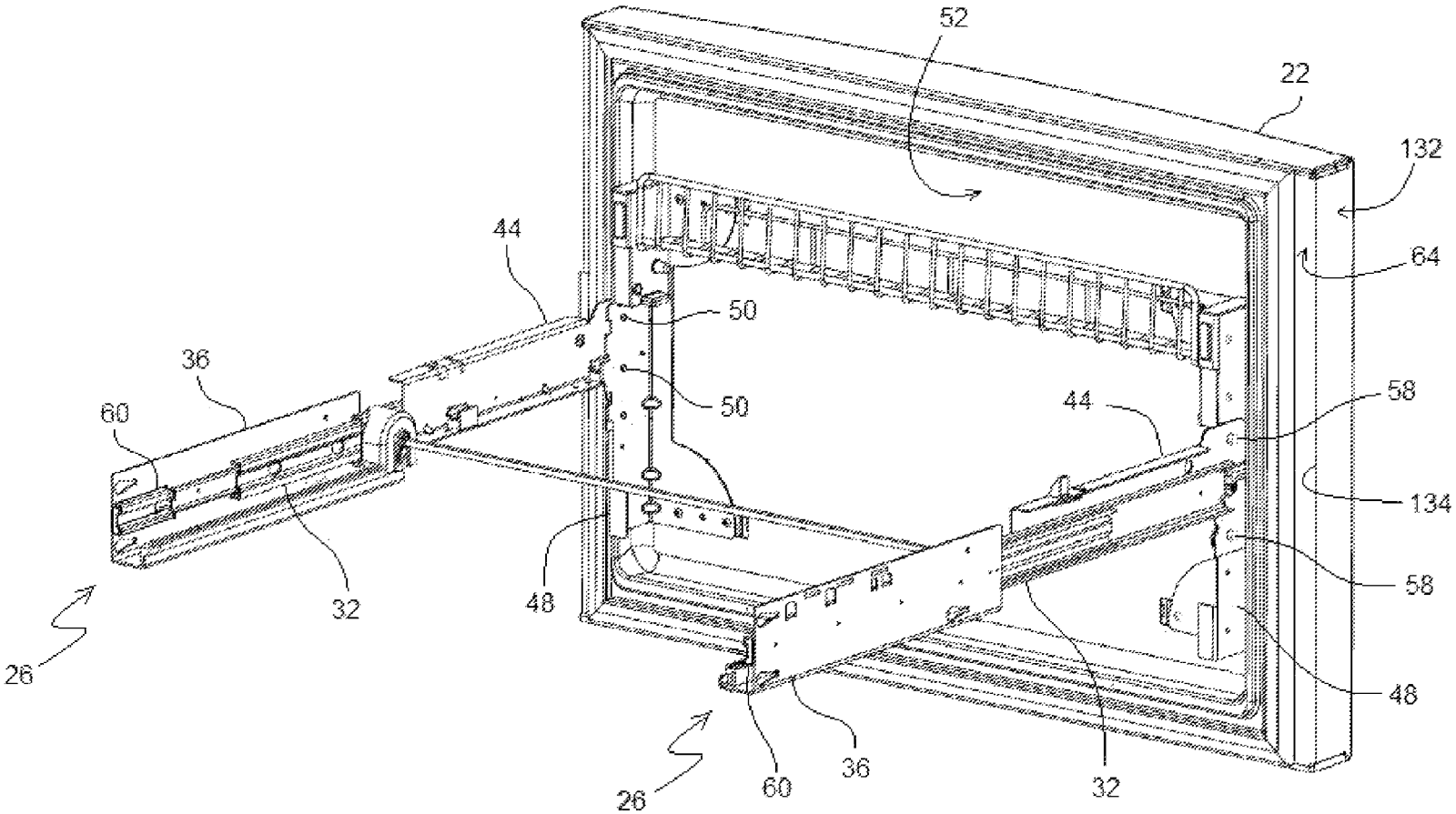
FIG. 2 is a perspective view of a door of the apparatus coupled to a pair of coupling mechanisms.
Figure 4:
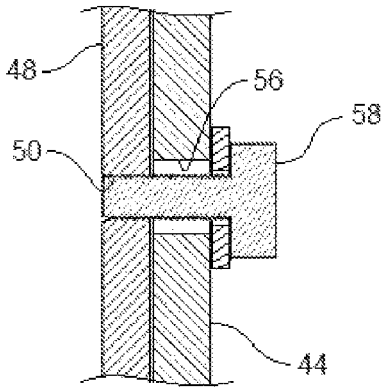
FIG. 4 is a cross-section view of the coupling between the door and a coupling mechanism.
Figure 3:
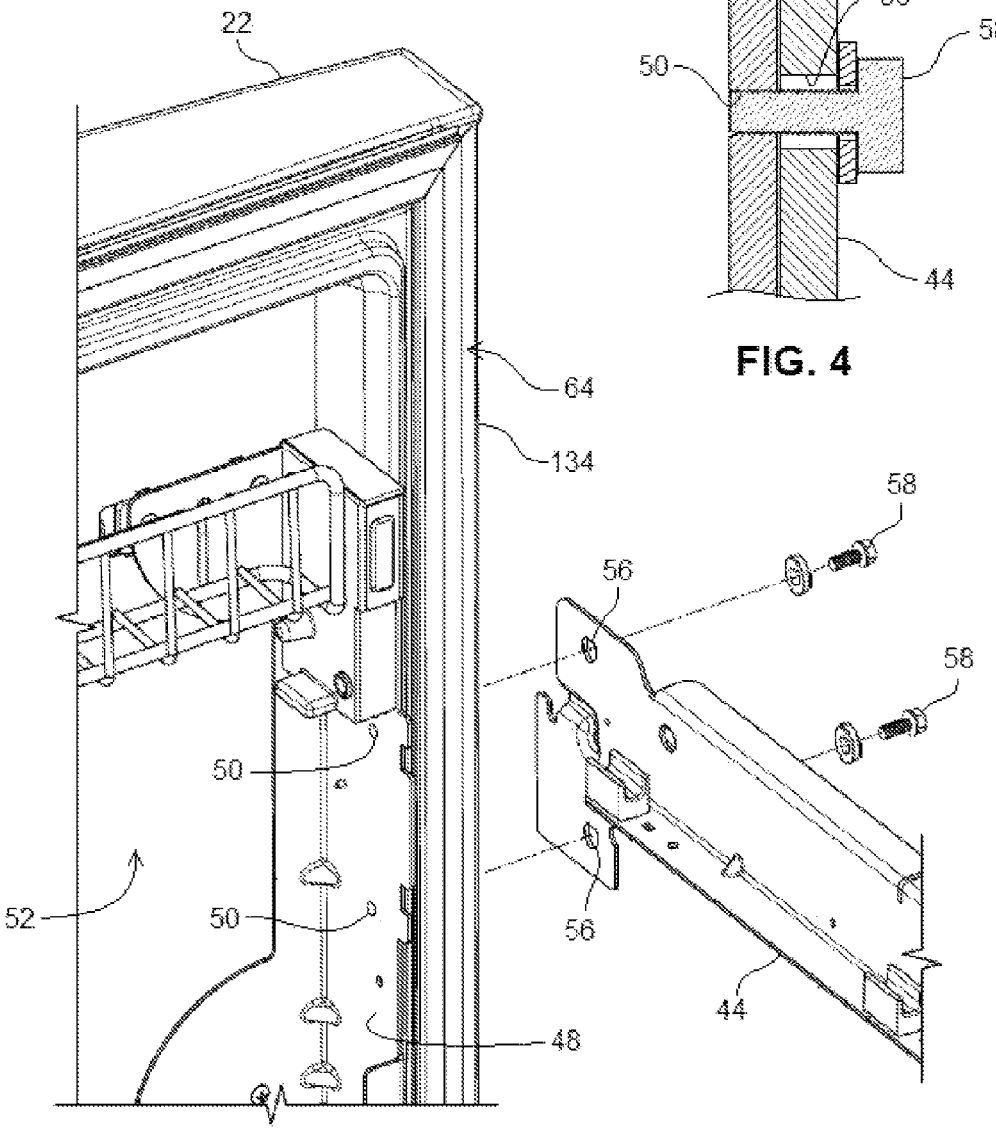
FIG. 3 is an exploded view of a coupling between the door and a coupling mechanism.
Figure 5:
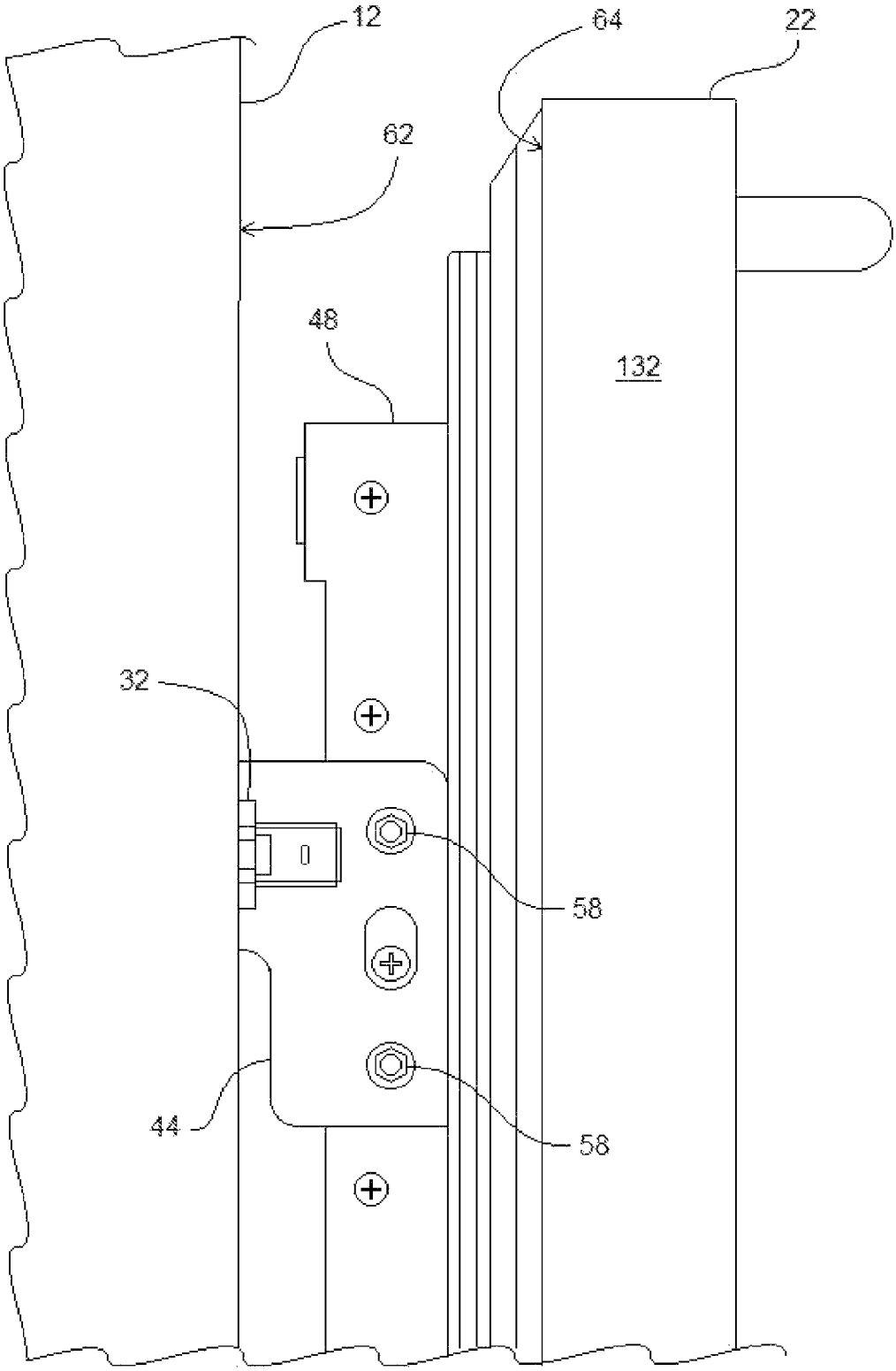
FIG. 5 is a side view of the apparatus.

Examples incorporating one or more embodiments are described and illustrated in the drawings. These illustrated examples are not intended to be limiting. For example, one or more aspects of an embodiment may be utilized in other embodiments and even other types of devices, such as a bottom-mount refrigerator, a top-mount refrigerator, or a side-by-side refrigerator. It is to be noted that the phrase "substantially parallel" as used herein means within 10 degrees or less of parallel, and more preferably, within 5 degrees or less of parallel.

Referring now to FIGS. 1-5, an example apparatus 10 is shown comprising a cabinet 12 defining an enclosure 14. The apparatus 10 in the present example is an appliance and, more specifically, a refrigerator with a fresh-food compartment with French doors and a bottom-mounted freezer compartment, the enclosure 14 being the freezer compartment. However, in some embodiments, the apparatus 10 can be a refrigerator with an alternative arrangement of compartments or a refrigerator with a single compartment. The apparatus 10 can be any cabinet-like structure that comprises a cabinet defining an enclosure and may be characterized as a drawer, a desk, a container, a chest, a safe, a cupboard, a cabinet or the like. The enclosure 14 of the cabinet 12 may provide a particular type of environment for items stored therein and, for example, may be suitable for refrigeration, heating, sanitization, a vacuum, etc.

The apparatus 10 can comprise a drawer assembly 20 that is insertable in the enclosure 14. The drawer assembly 20 can comprise a door 22 and a receptacle 24. The drawer assembly 20 can further comprise one or more coupling mechanisms 26 for movably coupling the door 22 and the receptacle 24 to the cabinet 12 to permit translational movement of the door 22 and the receptacle 24 relative to the cabinet 12. In the present example, the door 22 and the receptacle 24 are separate components that collectively form a drawer 28. However, in some examples, the door 22 and the receptacle 24 may be integral with each other. Moreover, in some examples, the drawer 28 may comprise the door 22 but not the receptacle 24.

The receptacle 24 may have a box-like shape that is insertable in the enclosure 14 though in some embodiments, the receptacle 24 may have a shape other than that of a box and, for example, may be semi-cylindrical. The receptacle 24 may be a basket formed from multiple parts such as interwoven wires or the receptacle 24 may be formed by molding polymeric material. When inserted in the enclosure 14, the receptacle 24 can make up the entire enclosure 14 or the receptacle 24 can make up a part of the enclosure 14. The receptacle 24 can be accessed directly from the exterior of the cabinet 12 by opening the door 22 or the receptacle 24 may need to be pulled out after the door 22 is first opened.

The coupling mechanisms 26 allow the drawer 28 to move between an extended, open position and a retracted, closed position. The coupling mechanisms 26 can be provided laterally of the drawer 28, for example, one on each side. Each coupling mechanism 26 may include a linear motion element 32 to allow the drawer 28 to move in and out of the enclosure 14 in a substantially linear motion. Furthermore, each coupling mechanism 26 can include a mounting bracket 36 about which the linear motion element 32 may be mounted. The mounting brackets 36 may be mounted on or near two interior surfaces 40 of the cabinet 12, which are disposed opposite one another in the enclosure 14.

The linear motion element 32 may, for example, be a slide mechanism that utilizes a plurality of elongate members that slide or glide against one another. The elongate members can be telescopic with varying cross-sections such that the elongate members can be housed within one another in the retracted position. The cross-sectional shapes can vary and in some examples, may have a "U" shape, a circular shape, etc. The linear motion element 32 may utilize plain bearings, ball bearings, roller bearings, or other means known in the art. The linear motion element 32 may utilize alternative structures such as wheels rolling about rails. The elongate members may include a stationary member and a moving member that moves relative to the stationary member to move between the retracted position and the extended position. In some examples, the elongate members may include one or more intermediate members linking the stationary member to the moving member such that the stationary member and the moving member correspond to the outermost portions of the linear motion element 32 in the extended position.

The coupling mechanisms 26 can each comprise a support member 44 that the receptacle 24 and/or the door 22 can be coupled to in order to support the receptacle 24 and/or the door 22. For example, in some embodiments, a set of door brackets 48 having one or more threaded apertures 50 may be mounted on an internal side 52 of the door 22 that faces the cabinet 12. The support members 44 can comprise one or more apertures 56 that correspond to the threaded apertures 50 of the door brackets 48. A fastener 58 can be inserted through each aperture 56 of the support members 44 and threaded into the corresponding threaded apertures 50 of the door brackets 48, thereby coupling the door 22 to the support members 44.

In some embodiments, the coupling mechanisms 26 can each comprise a closing mechanism 60 configured to pull the door 22 toward the cabinet 12 when the door 22 is coupled to its support member 44 and a distance between a surface of the cabinet 12 and a surface of the door 22 is less than a predetermined distance. For example, the closing mechanism 60 may be configured to pull the door 22 toward the cabinet 12 when a distance between a front surface 62 of the cabinet 12 and a rear surface 64 of the door 22 is less than a predetermined distance of, for example, 15 cm (5.9 in). However, in other examples, the surfaces and/or predetermined distance can vary.

During assembly of the apparatus 10, the door 22 can be adjustably coupled to the support members 44 so that the alignment of the door 22 relative to the support members 44 and cabinet 12 can be adjusted while the door 22 is coupled to and supported by the support members 44. For example, in some embodiments, the apertures 56 of the support members 44 can be over-sized (relative to the threaded members of the fasteners 58) and the fasteners 58 can be inserted through each aperture 56 and loosely threaded into the corresponding threaded apertures 50 of the door brackets 48, thereby coupling the door 22 to the support members 44 but allowing the door brackets 48 to move horizontally and vertically relative to the support members 44 while the door 22 is coupled to the support members 44. When adjustably coupled to the support members 44 in this manner, the door 22 can be aligned relative to the support members 44 and the cabinet 12. For example, the door 22 can be aligned such that the rear surface 64 of the door 22 is parallel to the front surface 62 of the cabinet 12. Preferably, the door 22 can be aligned such that the door 22 slides into sealing engagement with the cabinet 12 when the drawer 28 is in the closed position. Once the door 22 is aligned relative to the support members 44 and the cabinet 12, the door 22 can be fixedly coupled to the support members 44 by, for example, tightening the fasteners 58 so that the door 22 cannot move relative to the support members 44.

Although specific examples are provided above describing ways in which the door 22 can be adjustably or fixedly coupled to the support members 44 of the coupling mechanisms 26, the door 22 can be adjustably or fixedly coupled to the support members 44 in a variety of other ways without departing from the scope of the invention.

Figure 6:
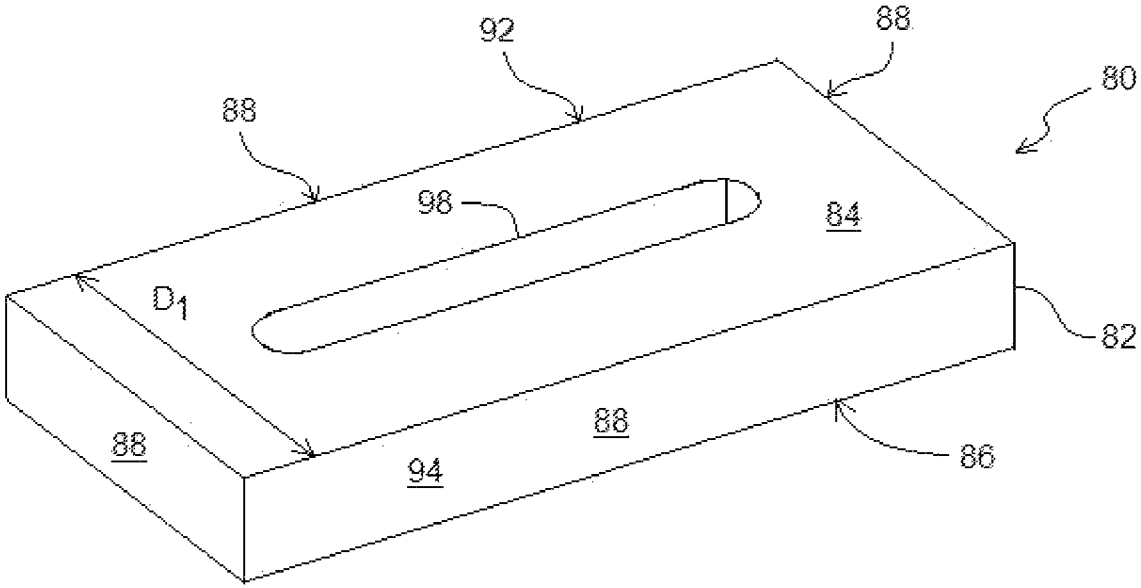
FIG. 6 is a perspective view of a first alignment guide for assembling the apparatus.
Figure 7:
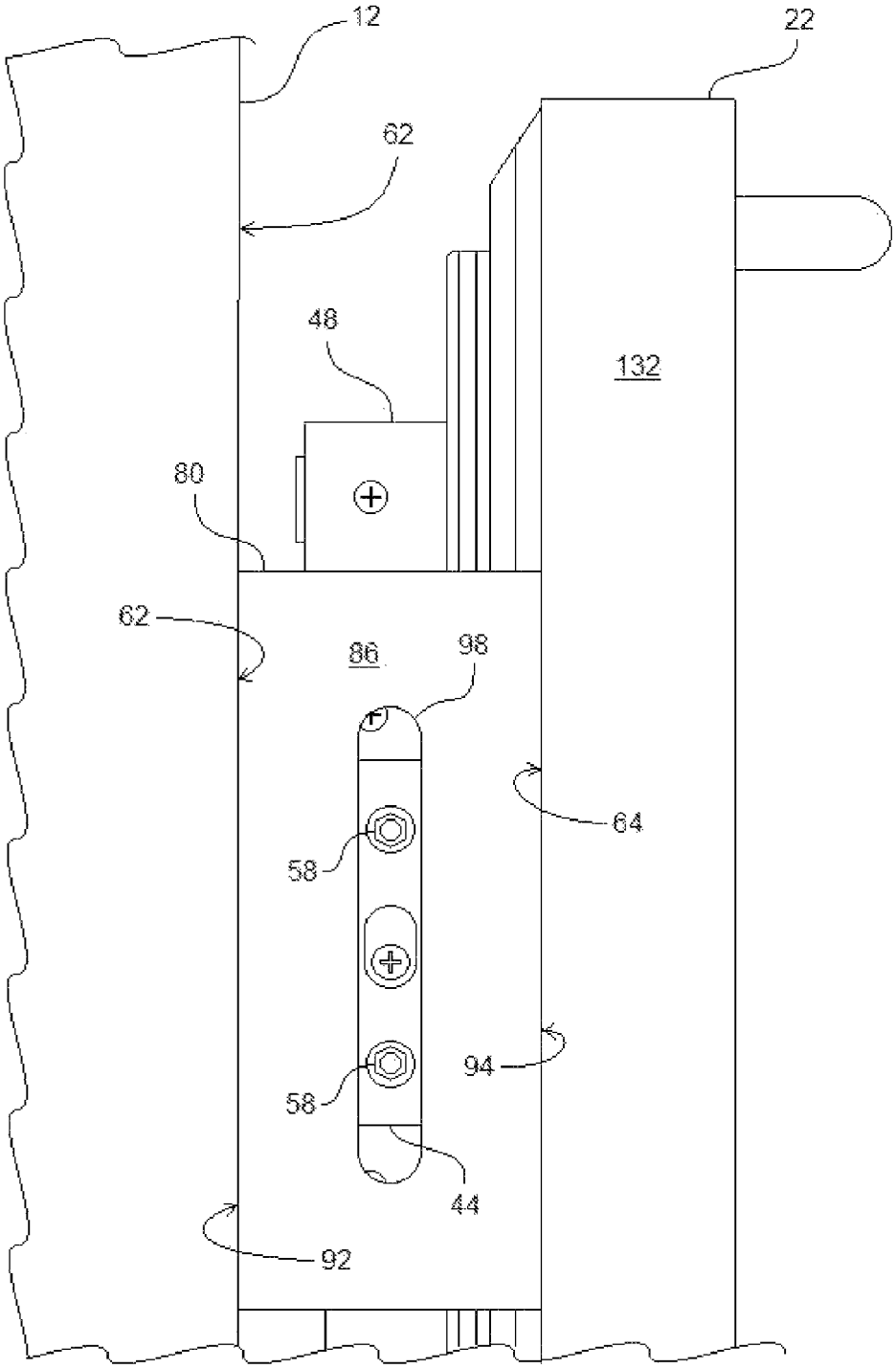
FIG. 7 is a side view of the apparatus being assembled with the first alignment guide.

Turning now to FIGS. 6-7, an example alignment guide 80 for use in assembling the above apparatus 10 will now be described. The alignment guide 80 comprises a body 82 having a first major surface 84, an opposing second major surface 86, and four edge surfaces 88 that extend between and intersect with the first and second major surfaces 84, 86. The edge surfaces 88 and the first and second major surfaces 84, 86 of the body 82 are all rectangular, planar surfaces that form right angles at their intersection, thereby forming a rectangular cuboid shape. However, the body 82 of the alignment guide 80 in some examples can have a shape other than a rectangular cuboid shape such as, for example, a rectangular parallelpiped shape, a cubic shape, or any other shape capable of performing the function described herein without departing from the scope of the invention.

The body 82 can comprise a first abutment surface 92 for abutting against a surface of the cabinet 12 or door 22 and a second abutment surface 94 for abutting against a surface of the other of the cabinet 12 or door 22. The first and second abutment surfaces 92, 94 in the present example are opposing edge surfaces 88 of the body 82 though in some examples, the first and second abutment surfaces 92, 94 can be other surfaces of the body 82. The first and second abutment surfaces 92, 94 can extend substantially parallel to each other or the first and second abutment surfaces 92, 94 can extend transverse to each other. In the present example, the first and second abutment surfaces 92, 94 extend parallel to each other and are spaced apart a distance $D_1$.

The alignment guide 80 can comprise at least one aperture that extends through the body 82. For instance, the alignment guide 80 can comprise an aperture 98 that extends through the body 82 from the first major surface 84 to the second major surface 86. The aperture 98 can be elongated and can extend longitudinally in a direction substantially parallel to the first and second abutment surfaces 92, 94, as in the present example, or the aperture 98 can extend longitudinally in a direction transverse to the first and second abutment surfaces 92, 94. The aperture 98 can extend through the body 82 according to a variety of configurations without departing from the scope of the invention.

In some embodiments, the alignment guide 80 can be made of a low weight, rigid material such as, for example, expanded polystyrene. Using a low weight, rigid material such as expanded polystyrene can make it easier to handle the alignment guide 80 when using the alignment guide 80 to assemble the apparatus 10. However, the alignment guide 80 can comprise a variety of other materials without departing from the scope of the invention.

With reference to FIG. 7, a method will now be described for assembling the above apparatus 10 with the alignment guide 80. The method can comprise the step of aligning the door 22 relative to the support members 44 and cabinet 12 with the alignment guide 80. More specifically, the door 22 can be aligned relative to the support members 44 and cabinet 12 with the alignment guide 80 by abutting the first abutment surface 92 of the alignment guide 80 against a surface of the cabinet 12 or door 22 while abutting the second abutment surface 94 of the alignment guide 80 against a surface of the other of the cabinet 12 or door 22. For example, as shown in FIG. 7, the door 22 can be aligned by abutting the first abutment surface 92 against the front surface 62 of the cabinet 12 such that the first abutment surface 92 and the front surface 62 are substantially flush and parallel. While the first abutment surface 92 abuts the front surface 62, the second abutment surface 94 can abut against the rear surface 64 of the door 22 such that the second abutment surface 94 and the rear surface 64 are substantially flush and parallel. Although FIG. 7 shows the first abutment surface 92 abutting the front surface 62 of the cabinet 12 and the second abutment surface 94 abutting the rear surface 64 of the door 22, in some examples, the door 22 can be aligned by abutting the second abutment surface 94 against the front surface 62 of the cabinet 12 and the first abutment surface 92 against the rear surface 64 of the door 22. Moreover, the door 22 can be aligned by abutting the first and second abutment surfaces 92, 94 against surfaces of the door 22 and cabinet 12 besides the surfaces 62, 64.

The body 82 of the alignment guide 80 can be configured such that as a result of simultaneous abutment of the first and second abutment surfaces 92, 94 with the surfaces of the door 22 and cabinet 12, the door 22 and cabinet 12 will be aligned relative to each other. For example, if the body 82 is configured such that the first and second abutment surfaces 92, 94 are substantially parallel to each other, simultaneous abutment of the first and second abutment surfaces 92, 94 with the surfaces 62, 64 of the cabinet 12 and door 22 will result in the surfaces 62, 64 being substantially parallel to each other. Preferably, the body 82 is configured such that as a result of simultaneous abutment of the first and second abutment surfaces 92, 94 with the surfaces 62, 64 of the cabinet 12 and door 22, the door 22 (if fixed in this position relative to the support members 44) will slide into sealing engagement with the cabinet 12 when the alignment guide 80 is removed and the drawer 28 is moved to the closed position.

As discussed above, in some embodiments, the coupling mechanisms 26 of the apparatus 10 can each comprise a closing mechanism 60 configured to pull the door 22 toward the cabinet 12 when the door 22 is coupled to its support member 44 and a distance between a surface of the cabinet 12 and a surface of the door 22 is less than a predetermined distance. In some examples, the alignment guide 80 can be configured such that when the door 22 is aligned relative to the cabinet 12 with the alignment guide 80 by abutting the first and second abutment surfaces 92, 94 against the surfaces of the cabinet 12 and door 22 as discussed above, the distance between the surfaces of the cabinet 12 and door 22 will be less than the predetermined distance. For example, the distance $D_1$ between the first and second abutment surfaces 92, 94 can be less than the predetermined distance such that when the first abutment surface 92 abuts the front surface 62 of the cabinet 12 and the second abutment surface 94 abuts the rear surface 64 of the door 22, the distance between the surfaces 62, 64 of the cabinet 12 and door 22 will be substantially equivalent to the distance $D_1$ and less than the predetermined distance. In such an example, if the door 22 is coupled to a support member 44 of one of the coupling mechanisms 26, its corresponding closing mechanism 60 will pull the rear surface 64 of the door 22 against the alignment guide 80, thereby providing a compressive force against the alignment guide 80 to help hold the position of the alignment guide 80.

Once the door 22 is aligned relative to the support members 44 and cabinet 12 with the alignment guide 80, the method can comprise the step of fixedly coupling the door 22 to one or both of the support members 44 of the coupling mechanisms 26 while the door 22 is aligned to the cabinet 12 with the alignment guide 80. For example, the door 22 can be fixedly coupled to the support members 44 using the fasteners 58 so that the door 22 cannot move relative to the support members 44, though in other examples, the door 22 can be fixedly coupled to the support members 44 using other means known in the art. After the door 22 is fixedly coupled to one or both of the support members 44, the alignment guide 80 can be removed by separating the first abutment surface 92 from the front surface 62 of the cabinet 12 and separating the second abutment surface 94 from the rear surface 64 of the door 22. By fixing the door 22 to one or both of the support members 44 prior to separating the first and second abutment surfaces 92, 94 from the cabinet 12 and door 22, the door 22 will remain in its aligned state even after the alignment guide 80 is removed.

In some examples, the method can comprise the step of adjustably coupling the door 22 to one or both of the support members 44 of the coupling mechanisms 26 before aligning the door 22 relative to the cabinet 12 with the alignment guide 80. More specifically, the door 22 can be adjustably coupled to one or both of the support members 44 so that the door 22 can be aligned with the alignment guide 80 while the door 22 is coupled to and supported by the support members 44. For example, as discussed above, the fasteners 58 can be inserted through the apertures 56 of the support members 44 and loosely threaded into the corresponding threaded apertures 50 of the door brackets 48 to adjustably couple the door 22, though the door 22 can be adjustably coupled to the support members 44 using other means known in the art in some examples.

In some examples, prior to fixing the door 22 to the support members 44 with the fasteners 58, the method can comprise the step of positioning the alignment guide 80 such that while the door 22 is aligned relative to the cabinet 12 with the alignment guide 80, the one or more of the fasteners 58 can be fastened with a fastening tool extending through the aperture 98 of the alignment guide 80, as shown in FIG. 7. The aperture 98 can be sized or otherwise configured such that in this position, a fastening tool such as, for example, a socket, can fit through the aperture 98 to fasten the one or more of the fasteners 58. By positioning the alignment guide 80 in this manner, the alignment guide 80 will not obstruct access to the one or more of the fasteners 58 by the fastening tool during the step of fixedly coupling the door 22 to the one or both of the support members 44.

Figure 8:
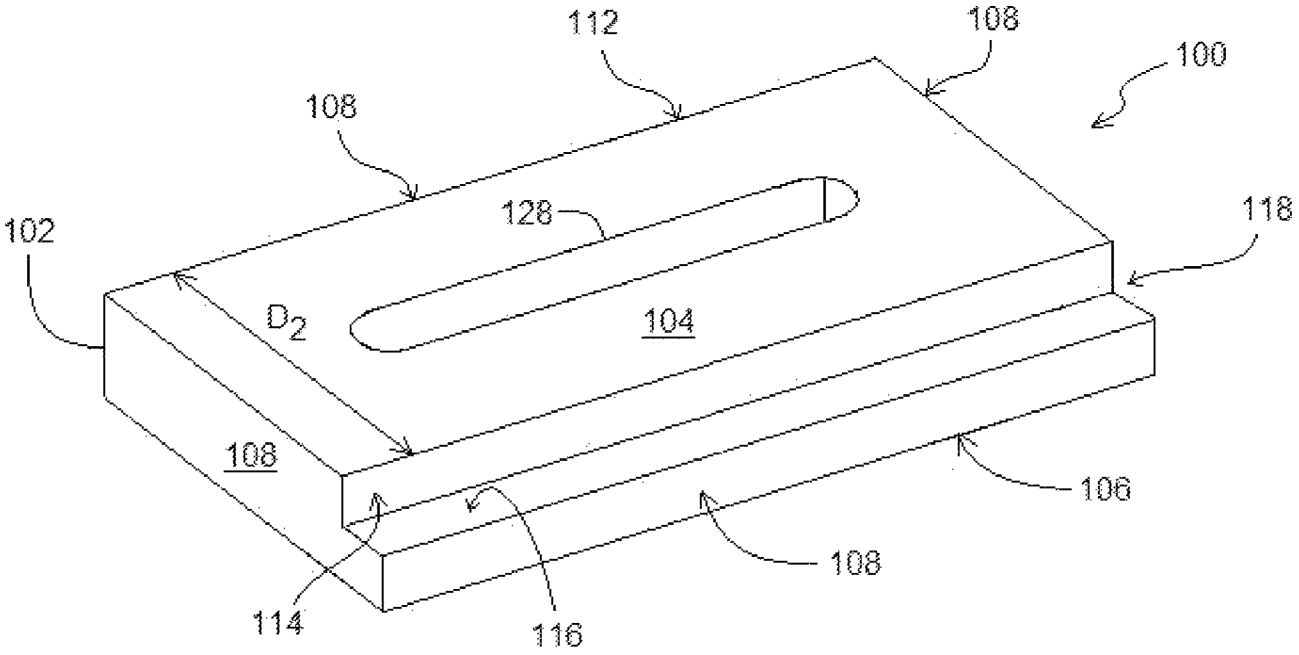
FIG. 8 is a perspective view of a second alignment guide for assembling the apparatus.
Figure 9:
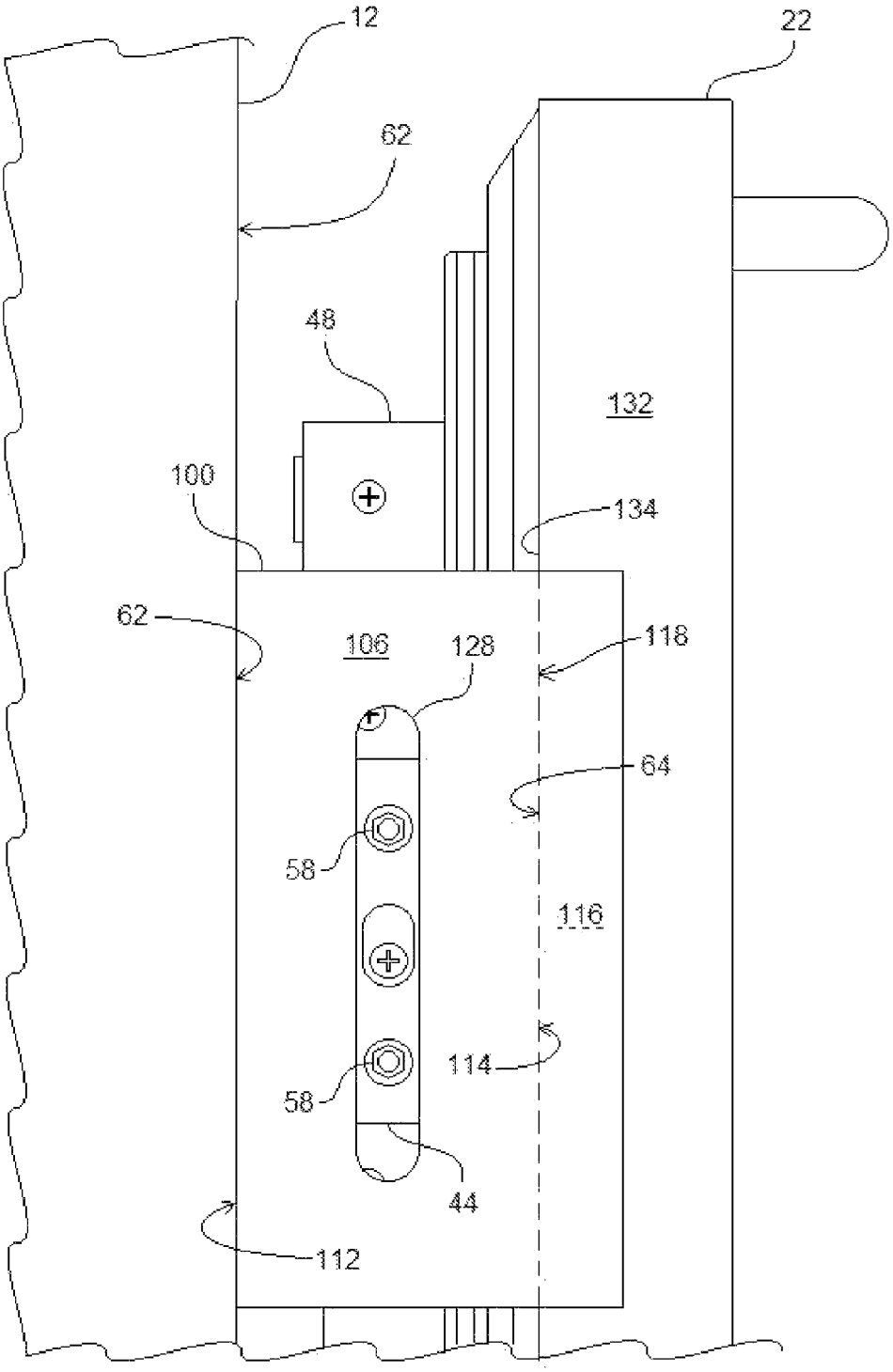
FIG. 9 is a side view of the apparatus being assembled with the second alignment guide.

Turning now to FIGS. 8-9, another example alignment guide 100 for use in assembling the above apparatus 10 will now be described. The alignment guide 100 comprises a body 102 having a first major surface 104, an opposing second major surface 106, and four edge surfaces 108 that extend between and intersect with the first and second major surfaces 104, 106. The first and second major surfaces 104, 106 are both rectangular, planar surfaces that extend parallel to each other, the second major surface 106 being wider than the first major surface 104. Meanwhile, two of the edges surfaces 108 are L-shaped, opposing, planar surfaces that extend perpendicular to the first and second major surfaces 104, 106. One of the other two edge surfaces 108 is a rectangular, planar surface that extends perpendicular to the first and second major surfaces 104, 106 while the fourth edge surface 108 is a stepped surface. However, the first and second major surfaces 104, 106 and the four edge surfaces 108 can take on a variety of other shapes and arrangements capable of performing the function described herein without departing from the scope of the invention.

The body 102 can comprise a first abutment surface 112, a second abutment surface 114, and a third abutment surface 116 for abutting against surfaces of the cabinet 12 or the door 22. The first and second abutment surfaces 112, 114 can extend parallel to each other while the third abutment surface 116 extends transverse to the first and second abutment surfaces 112, 114. Moreover, the third abutment surface 116 can intersect with one of the first and second abutment surfaces 112, 114 to form a shoulder which, as discussed below, can be configured to mate with a corner portion of one of the cabinet 12 and the door 22. In the present example, the first and second abutment surfaces 112, 114 extend parallel to each other and are spaced apart a distance $D_2$. Meanwhile, the third abutment surface 116 extends perpendicular to the first and second abutment surfaces 112, 114 and intersects with the second abutment surface 114 to form a shoulder 118. The first, second and third abutment surfaces 112, 114, 116 can take on a variety of different configurations without departing from the scope of the invention.

The alignment guide 100 can comprise at least one aperture that extends through the body 102. For instance, the alignment guide 100 can comprise an aperture 128 that extends through the body 102 from the first major surface 104 to the second major surface 106. The aperture 128 can be elongated and can extend longitudinally in a direction substantially parallel to the first and second abutment surfaces 112, 114, as in the present example, or the aperture 128 can extend longitudinally in a direction transverse to the first and second abutment surfaces 112, 114. The aperture 128 can extend through the body 102 according to a variety of configurations without departing from the scope of the invention.

In some embodiments, the alignment guide 100 can be made of a low weight, rigid material such as, for example, expanded polystyrene. Using a low weight, rigid material such as expanded polystyrene can make it easier to handle the alignment guide 100 when using the alignment guide 100 to assemble the apparatus 10. However, the alignment guide 100 can comprise a variety of other materials without departing from the scope of the invention.

With reference to FIG. 9, a method will now be described for assembling the above apparatus 10 with the alignment guide 100. The method can comprise the step of aligning the door 22 relative to the support members 44 and cabinet 12 with the alignment guide 100. More specifically, the door 22 can be aligned relative to the support members 44 and cabinet 12 with the alignment guide 100 by simultaneously abutting the first, second and third abutment surfaces 112, 114, 116 against surfaces of the cabinet 12 and door 22. For example, as shown in FIG. 9, the door 22 can be aligned by abutting the first abutment surface 112 against the front surface 62 of the cabinet 12 such that the first abutment surface 112 and the front surface 62 are substantially flush and parallel. While the first abutment surface 112 abuts the front surface 62, the second abutment surface 114 can abut against the rear surface 64 of the door 22 such that the second abutment surface 114 and the rear surface 64 are substantially flush and parallel. Moreover, the third abutment surface 116 can abut against a side surface 132 of the door 22 such that the third abutment surface 116 and the side surface 132 are substantially flush and parallel. The shoulder 118 formed by the second and third abutment surfaces 114, 116 is configured to mate with a corner portion 134 of the door 22 when the second and third abutment surfaces 114, 116 simultaneously abut the surfaces 64, 132 of the door 22.

By providing three abutment surfaces for the alignment guide 100 to abut against surfaces of the door 22 and cabinet 12, it can be easier to position and hold the alignment guide 100 against the surfaces of the door 22 and cabinet 12, particularly when two of the abutment surfaces are transverse to each other and form a shoulder for a corner portion of one of the cabinet 12 and door 22 to mate with.

The body 102 of the alignment guide 100 can be configured such that as a result of simultaneous abutment of the first, second and third abutment surfaces 112, 114, 116 with the surfaces of the door 22 and cabinet 12, the door 22 and cabinet 12 will be aligned relative to each other. For example, if the body 102 is configured such that the first and second abutment surfaces 112, 114 are substantially parallel to each other, simultaneous abutment of the first and second abutment surfaces 112, 114 with the surfaces 62, 64 of the cabinet 12 and door 22 will result in the surfaces 62, 64 being substantially parallel to each other. Preferably, the body 102 is configured such that as a result of simultaneous abutment of the first and second abutment surfaces 112, 114 with the surfaces 62, 64 of the cabinet 12 and door 22, the door 22 (if fixed in this position relative to the support members 44) will slide into sealing engagement with the cabinet 12 when the alignment guide 100 is removed and the drawer 28 is moved to the closed position.

As discussed above, in some embodiments, the coupling mechanisms 26 of the apparatus 10 can each comprise a closing mechanism 60 configured to pull the door 22 toward the cabinet 12 when the door 22 is coupled to its support member 44 and a distance between a surface of the cabinet 12 and a surface of the door 22 is less than a predetermined distance. In some examples, the alignment guide 100 can be configured such that when the door 22 is aligned relative to the cabinet 12 with the alignment guide 100 by abutting the first and second abutment surfaces 112, 114 against the surfaces of the cabinet 12 and door 22 as discussed above, the distance between the surfaces of the cabinet 12 and door 22 will be less than the predetermined distance. For example, the distance $D_2$ between the first and second abutment surfaces 112, 114 can be less than the predetermined distance such that when the first abutment surface 112 abuts the front surface 62 of the cabinet 12 and the second abutment surface 114 abuts the rear surface 64 of the door 22, the distance between the surfaces 62, 64 of the cabinet 12 and door 22 will be substantially equivalent to the distance $D_2$ and less than the predetermined distance. In such an example, if the door 22 is coupled to a support member 44 of one of the coupling mechanisms 26, its corresponding closing mechanism 60 will pull the rear surface 64 of the door 22 against the alignment guide 100, thereby providing a compressive force against the alignment guide 100 to help hold the position of the alignment guide 100.

Once the door 22 is aligned relative to the support members 44 and cabinet 12 with the alignment guide 100, the method can comprise the step of fixedly coupling the door 22 to one or both of the support members 44 of the coupling mechanisms 26 while the door 22 is aligned to the cabinet 12 with the alignment guide 100. For example, the door 22 can be fixedly coupled to the support members 44 using the fasteners 58 so that the door 22 cannot move relative to the support members 44, though in other examples, the door 22 can be fixedly coupled to the support members 44 using other means known in the art. After the door 22 is fixedly coupled to one or both of the support members 44, the alignment guide 100 can be removed by separating the first, second and third abutment surfaces 112, 114, 116 from the surfaces 62, 64, 132 of the cabinet 12 and door 22. By fixing the door 22 to one or both of the support members 44 prior to separating the first, second and third abutment surfaces 112, 114, 116 from the cabinet 12 and door 22, the door 22 will remain in its aligned state even after the alignment guide 100 is removed.

In some examples, the method can comprise the step of adjustably coupling the door 22 to one or both of the support members 44 of the coupling mechanisms 26 before aligning the door 22 relative to the cabinet 12 with the alignment guide 100. More specifically, the door 22 can be adjustably coupled to one or both of the support members 44 so that the door 22 can be aligned with the alignment guide 100 while the door 22 is coupled to and supported by the support members 44. For example, as discussed above, the fasteners 58 can be inserted through the apertures 56 of the support members 44 and loosely threaded into the corresponding threaded apertures 50 of the door brackets 48 to adjustably couple the door 22, though the door 22 can be adjustably coupled to the support members 44 using other means known in the art in some examples.

In some examples, prior to fixing the door 22 to the support members 44 with the fasteners 58, the method can comprise the step of positioning the alignment guide 100 such that while the door 22 is aligned relative to the cabinet 12 with the alignment guide 100, the one or more of the fasteners 58 can be fastened with a fastening tool extending through the aperture 128 of the alignment guide 100, as shown in FIG. 9. The aperture 128 can be sized or otherwise configured such that in this position, a fastening tool such as, for example, a socket, can fit through the aperture 128 to fasten the one or more of the fasteners 58. By positioning the alignment guide 100 in this manner, the alignment guide 100 will not obstruct access to the one or more of the fasteners 58 by the fastening tool during the step of fixedly coupling the door 22 to the one or both of the support members 44.

A number of examples have been described above. Nevertheless, it will be understood that various modifications may be made. For example, suitable results may be achieved if the described elements are combined in a different manner and/or replaced or supplemented by other elements or their equivalents.

What is claimed is:

1. A method of assembling an apparatus using an alignment guide comprising a body having a first abutment surface and a second abutment surface, the apparatus comprising a cabinet defining an enclosure, a door, and a coupling mechanism for movably coupling the door to the cabinet to permit translational movement of the door relative the cabinet, the method comprising:

aligning the door relative to the cabinet with the alignment guide by abutting the first abutment surface of the alignment guide against a surface of the cabinet while abutting the second abutment surface of the alignment guide against a surface of the door; and fixedly coupling the door to a support member of the coupling mechanism while the door is aligned to the cabinet with the alignment guide, wherein the door is fixedly coupled to the support member with at least one fastener, and wherein the alignment guide comprises an aperture extending through the body, further wherein while the door is aligned relative to the cabinet with the alignment guide, the alignment guide is positioned such that the at least one fastener can be fastened with a fastening tool extending through the aperture.

2. The method of claim 1, wherein the door is aligned relative to the cabinet with the alignment guide by abutting the first abutment surface of the alignment guide against a front surface of the cabinet while abutting the second abutment surface of the alignment guide against a rear surface of the door.

3. The method of claim 1, wherein the first abutment surface and the second abutment surface are substantially parallel to each other.

4. The method of claim 1, wherein the aperture is elongated and extends longitudinally in a direction substantially parallel to the first abutment surface and the second abutment surface.

5. The method of claim 1, further comprising adjustably coupling the door to the support member before aligning the door relative to the cabinet.

6. The method of claim 1, further comprising separating the first abutment surface from the surface of the cabinet and separating the second abutment surface from the surface of the door after the door is fixedly coupled to the support member.

7. The method of claim 1, wherein the body of the alignment guide comprises a third abutment surface that extends transverse to the first and second abutment surfaces.

8. The method of claim 7, wherein the door is aligned relative to the cabinet with the alignment guide by abutting the third abutment surface of the alignment guide against a second surface of the door or cabinet.

9. The method of claim 7, wherein the third abutment surface intersects with one of the first and second abutment surfaces to form a shoulder configured to mate with a corner portion of the door or cabinet.

10. A method of assembling an apparatus using an alignment guide comprising a body having a first abutment surface and a second abutment surface, the apparatus comprising a cabinet defining an enclosure, a door, and a coupling mechanism for movably coupling the door to the cabinet to permit translational movement of the door relative the cabinet, the method comprising:

aligning the door relative to the cabinet with the alignment guide by abutting the first abutment surface of the alignment guide against a surface of the cabinet while abutting the second abutment surface of the alignment guide against a surface of the door; and fixedly coupling the door to a support member of the coupling mechanism while the door is aligned to the cabinet with the alignment guide, wherein the coupling mechanism comprises a closing mechanism configured to pull the door toward the cabinet when the door is coupled to the support member and a distance between the surface of the cabinet and the surface of the door is less than a predetermined distance.

11. The method of claim 10, wherein when the first abutment surface of the alignment guide abuts the front surface of the cabinet and the second abutment surface of the alignment guide abuts the rear surface of the door, the distance between the surface of the cabinet and the surface of the door is less than the predetermined distance.

12. The method of claim 10, wherein when the first abutment surface of the alignment guide abuts the surface of the cabinet and the second abutment surface of the alignment guide abuts the surface of the door, the closing mechanism pulls the surface of the door against the second abutment surface.

13. An alignment guide for assembling an apparatus comprising a cabinet defining an enclosure, a door, and a coupling mechanism for movably coupling the door to the cabinet to permit translational movement of the door relative the cabinet, the alignment guide comprising:

a body having a first abutment surface for abutting against a surface of the cabinet and a second abutment surface for abutting against a surface of the door while the first abutment surface abuts the surface of the cabinet; and an aperture extending through the body, wherein the door can be aligned relative to the cabinet with the alignment guide by abutting the second abutment surface against the surface of the door while the first abutment surface abuts the surface of the cabinet, the door can be fixedly coupled to a support member of the coupling mechanism with at least one fastener, and the aperture is configured such that a fastening tool can extend through the aperture to fasten the fastener while the door is aligned relative to the cabinet with the alignment guide.

14. The alignment guide of claim 13, further comprising a third abutment surface extending transverse to the first and second abutment surfaces for abutting against a second surface of the door or cabinet.

15. The alignment guide of claim 14, wherein the third abutment surface intersects with one of the first and second abutment surfaces to form a shoulder configured to mate with a corner portion of the door or cabinet.

16. The alignment guide of claim 13, wherein the coupling mechanism comprises a closing mechanism configured to pull the door toward the cabinet when the door is coupled to the support member and a distance between the surface of the cabinet and the surface of the door is less than a predetermined distance, further wherein the alignment guide is configured such that when the first abutment surface of the alignment guide abuts the front surface of the cabinet and the second abutment surface of the alignment guide abuts the rear surface of the door, the distance between the surface of the cabinet and the surface of the door is less than the predetermined distance.

17. The alignment guide of claim 13, wherein the first abutment surface and the second abutment surface are substantially parallel to each other.

18. The alignment guide of claim 17, wherein the aperture is elongated and extends longitudinally in a direction substantially parallel to the first abutment surface and the second abutment surface.

* * * * *